US007641607B2

(12) United States Patent
Martin et al.

(10) Patent No.: US 7,641,607 B2
(45) Date of Patent: Jan. 5, 2010

(54) PACKAGING MACHINE WITH FOLDING APPARATUS

(75) Inventors: Alan P. Martin, Smyrna, GA (US); John W. Cash, III, Newnan, GA (US); Rafe T. Patterson, Newnan, GA (US); Michael F. Flagg, Newnan, GA (US)

(73) Assignee: MeadWestVaco Packaging Systems, LLC, Glen Allen, VA (US)

( * ) Notice: Subject to any disclaimer, the term of this patent is extended or adjusted under 35 U.S.C. 154(b) by 0 days.

(21) Appl. No.: 11/925,812

(22) Filed: Oct. 27, 2007

(65) Prior Publication Data

US 2008/0120948 A1 May 29, 2008

Related U.S. Application Data

(60) Provisional application No. 60/863,362, filed on Oct. 28, 2006.

(51) Int. Cl.
*B31B 1/48* (2006.01)
*B65B 7/08* (2006.01)

(52) U.S. Cl. ..... 493/70; 493/80; 493/183; 493/260; 53/376.3; 53/377.2; 53/387.2; 53/491

(58) Field of Classification Search ..... 53/376.3, 53/376.4, 376.7, 377.2, 377.6, 377.8, 378.3, 53/387.2, 491, 284.5; 493/70, 80, 183, 156, 493/157, 179, 180, 260, 261
See application file for complete search history.

(56) References Cited

U.S. PATENT DOCUMENTS

| | | | | |
|---|---|---|---|---|
| 4,871,070 | A * | 10/1989 | Langen et al. | 206/591 |
| 5,417,032 | A | 5/1995 | Calvert | |
| 5,664,401 | A | 9/1997 | Portrait | |
| 5,778,630 | A | 7/1998 | Portrait | |
| 6,571,539 | B2 * | 6/2003 | Gendre et al. | 53/456 |

FOREIGN PATENT DOCUMENTS

| | | |
|---|---|---|
| EP | 0322159 B1 | 8/1992 |
| EP | 1123236 B1 | 4/2004 |

* cited by examiner

*Primary Examiner*—Hemant M Desai
(74) *Attorney, Agent, or Firm*—Karen L. Ware; Tsugihiko Suzuki

(57) ABSTRACT

A packaging machine having a folding apparatus for closing an end of an end loaded carton that includes leading and trailing side end flaps. The packaging machine includes a carton conveyor for transporting a carton in a flow direction along a carton path. The folding apparatus includes a lug assembly that has at least one folding lug that travels along an endless lug path. The folding lug travels in the flow direction and in parallel to the carton path along at least a portion of the lug path such that the folding lug can operate in concert with separation guide and a combination guide to fold the leading and trailing side end flaps in the desired sequence.

5 Claims, 9 Drawing Sheets

210
200
216
210
210
250
222
250
232c
270
272
234a
232a
N2
242
244
242
244
274
276/278
280
230b
232d
274
240
234b
250
232b
230a
250
MATCH LINE
TO FIG. 3B 222
280
276/278
270
272
234a
210
N2
232c
230b
244
240
244
200
250
240
250
212
230a
N1
232a
260
210
216
262
220

PACKAGING MACHINE WITH FOLDING APPARATUS

CROSS REFERENCE TO RELATED APPLICATIONS

This application claims priority to U.S. Provisional Application No. 60/863,362, filed Oct. 28, 2006, the entirety of which is incorporated herein by reference.

TECHNICAL FIELD

This invention relates generally to packaging machines and, more specifically, to packaging machines that include a folding apparatus.

BACKGROUND

Certain end loaded cartons are intended to package heavy articles, such as large glass bottles, and therefore need to be sturdily constructed. These cartons can accordingly include end closures that are reinforced by incorporating relatively longer side end flaps, often referred to as minor end flaps. Longer minor end flaps have larger surface areas for receiving hot glue or other adhesives and can therefore provide a stronger connection to major end flaps, when forming end closures. The minor end flaps may be long enough such that, for example, they at least partially overlap.

A problem associated with these cartons is that longer minor end flaps cannot be easily folded by conventional packaging machines that include folding wheels, particularly when the minor end flaps overlap one another. Therefore, a heretofore unaddressed need exists in the industry to address the aforementioned deficiencies and inadequacies.

SUMMARY

The various embodiments of the present invention overcome the shortcomings of the prior art by providing a packaging machine that includes a folding apparatus. The folding apparatus facilitates folding the end flaps of a carton, and is particularly useful for folding long side end flaps, side end flaps that overlap one another, and side end flaps with various lengths. The end flap folding apparatus can be easily changed over to accommodate various carton configurations and/or to change the side end flap folding sequence.

Generally described, the folding apparatus includes a lug assembly that cooperates with guides to achieve folding operations. The lug assembly includes folding lugs that travel along a preferably endless lug path, although reciprocating lugs are contemplated. Along at least a portion of the lug path, the folding lug moves in a direction that is the same as the flow direction of cartons, which are transported by a carton conveyor.

The present invention can be implemented in a packaging machine that is configured for closing an end of an end loaded carton that has leading and trailing side end flaps. The packaging machine includes, in relevant part, a carton conveyor for transporting cartons in a flow direction along a first path and a folding apparatus for folding the end flaps of the cartons. For purposes of teaching and not of limitation, the exemplary carton conveyor is a flat belt, roller, wheel or chain conveyor that defines a substantially linear course, although the principles of the invention are equally applicable with any suitable conveying system, which may for example, include or consist of curvilinear segments.

The folding apparatus includes a lug assembly that has at least one folding lug that travels along a second path. According to one aspect of the invention, the folding lugs travel in the flow direction along at least a portion of the second path that is substantially parallel to the first path to fold the trailing side end flaps of cartons. As used herein, the substantially parallel portion of the second path can be defined where the folding lug is in working reach of the end flaps of the cartons.

The folding apparatus further includes a separation guide that is disposed at an upstream end of the folding apparatus and a combination guide that is disposed at a downstream end of the folding apparatus. The separation guide functions to separate the side end flaps of adjacent cartons, specifically, the trailing side end flap of a leading carton and the leading side end flap of a trailing carton. The combination guide functions to fold the leading side end flaps of the cartons in cooperation with the folding lug folding the trailing side end flaps of the cartons.

As used herein, the first path and a portion of the second path are described as being substantially parallel where the movement of both the cartons and the folding lugs is in the flow direction along an operational length of the folding apparatus. It should be noted that the operational length of the folding apparatus facilitates folding the end flaps according to different methods.

Each of the substantially parallel paths can slightly deviate from, oscillate about, or otherwise be defined as a function of a notional path that extends in the flow direction. For example, the first path and the portion of the second path can slightly converge toward or diverge from one another while still positioning the cartons and lugs to provide the functionality described herein. In certain embodiments, the first path is substantially linear and the second path is endless and includes a linear portion that is substantially parallel to the first path.

The speed and position of a folding lug along the first path and the speed and position of a carton along the second path are synchronized. To synchronize the speed and position of both the folding lug and the carton, the packaging machine includes means for driving the carton conveyor, means for driving the lug assembly, and means for controlling both means for driving the carton conveyor and means for driving the folding apparatus. The various drive means can include any suitable mechanism, including but not limited to, electrically, hydraulically, pneumatically, or magnetically powered motion control devices, such as servos and the like. Control means can include a processor driven device such as a programmable automation controller (PAC), a programmable logic controller (PLC), or any other suitable electronic apparatus which uses a programmable memory for the internal storage of instructions for implementing specific functions, such as logic, sequencing, timing, counting and arithmetic, to control through digital or analog input/output, various types of machines or processes.

The folding apparatus of the packaging machine can close an end of a carton that has leading and trailing side end flaps in various different ways to achieve the desired sequence and timing of folding, or according to the characteristics of all of the end flaps. According to a first exemplary method, a first end loaded carton is translated along the first path in the flow direction such that the first carton is translated past the combination guide to fold the leading side end flap and the folding lug is translated along the second path in the flow direction. The speed and position of the folding lug are controlled along the second path relative to the speed and position of the first carton such that the folding lug folds the trailing side end flap.

In certain embodiments, the step of translating the first carton further includes translating the first carton past the separation guide to fold the leading and trailing side end flaps and releasing the leading and trailing side end flaps as the distal end of each reaches the downstream end of the separation guide. The step of translating a folding lug can also include controlling the speed and position of the folding lug to pass the downstream end of the separation guide after the trailing end flap of the first carton is released and before the leading end flap of a second carton is released.

To accommodate cartons with different characteristics or desired folding sequences, change over is achieved by simply adjusting or varying the speed and position of the folding lugs along the path, relative to the speed and position of the cartons traveling along the path defined by the carton conveyor, and/or by adjusting the positions of the guides.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
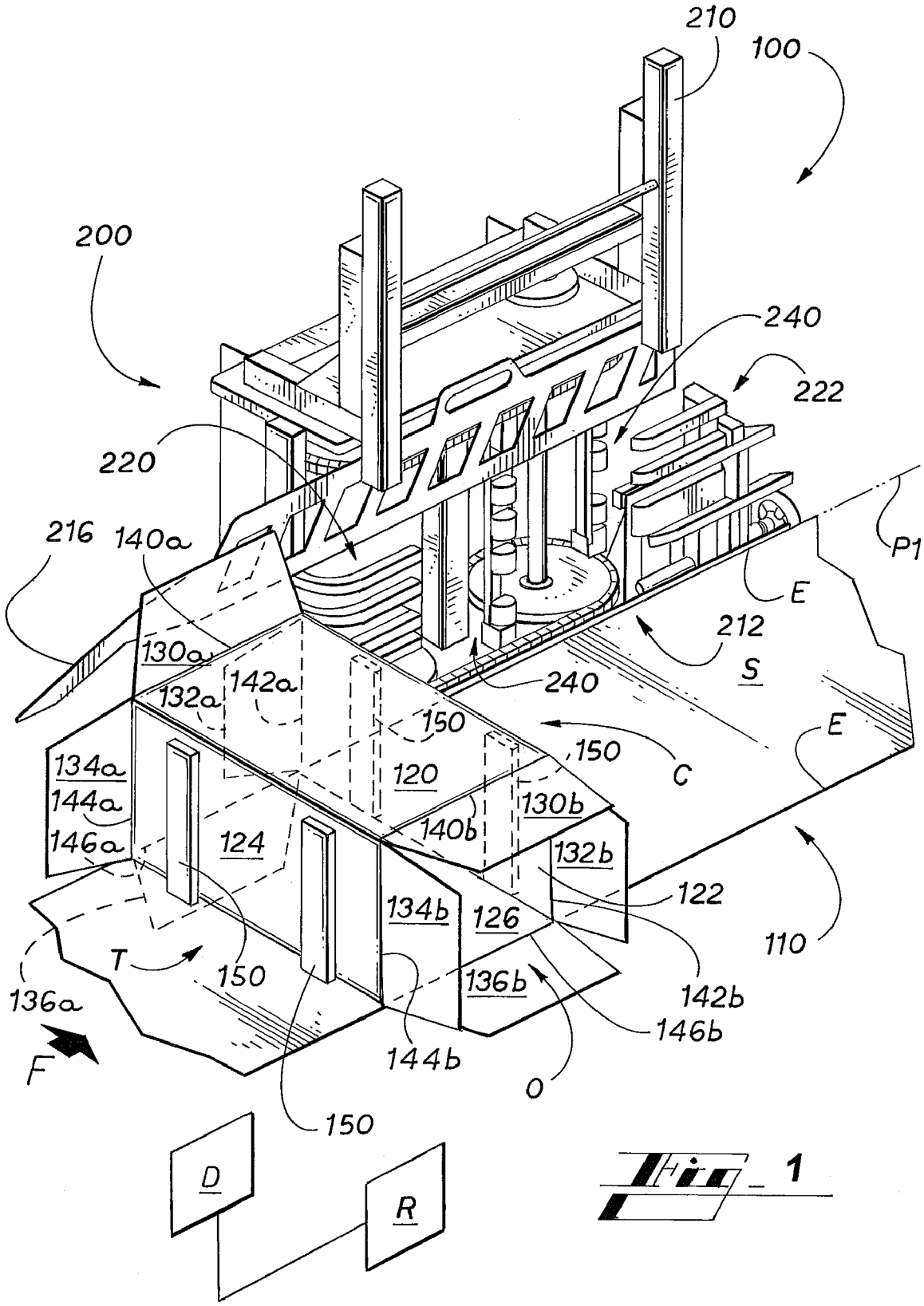
FIG. 1 is a partial perspective view of a packaging machine that includes a folding apparatus, according to an exemplary embodiment of the present invention.
Figure 2:
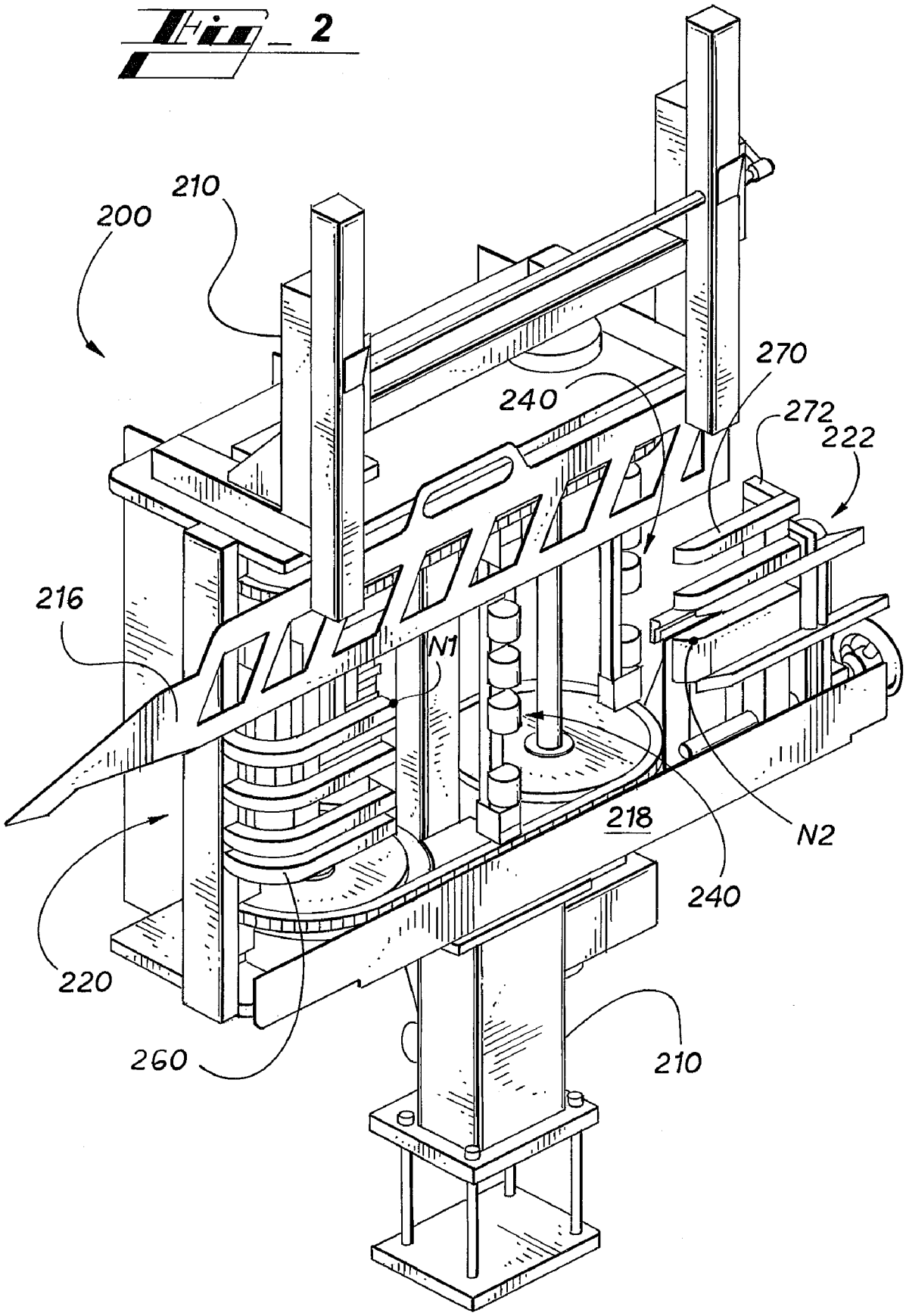
FIG. 2 is a perspective view of the folding apparatus of the packaging machine of FIG. 1.

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Referring now to the drawings, wherein like numerals indicate like elements throughout the several views, the drawings illustrate certain of the various aspects of an exemplary embodiment of a packaging machine that includes a folding apparatus.

Referring to FIG. 1, an exemplary packaging machine 100 includes a carton conveyor 110 and a folding apparatus 200. The carton conveyor 110 transports end loaded cartons C in a flow direction F along a carton path P1. The folding apparatus 200 is positioned to be adjacent to the carton conveyor 110 so as to be able to fold the end flaps of the cartons C that are transported along the carton path P1, as described in further detail below. The carton conveyor 110 is coupled to means for driving, such as a conveyor motor D, the operation of which determines the movement, including the position and speed, of the cartons C along the carton path P1. Means for driving is described in further detail below.

The conveyor motor D is controlled by means for controlling R, which provides an input thereto. Means for controlling R is described in further detail below. It should be understood that the conveyor motor D can operate at speeds that are constant or variable over time.

For purposes of teaching, the carton path P1 is illustrated as being substantially linear. However, it is contemplated that the carton path P1 can curve or otherwise be nonlinear, and that the carton path may be an endless loop.

Each carton C can be configured as a tubular structure T having open ends O. A top wall 120, a first side wall 122, a second side wall 124, and a bottom wall 126 define the tubular structure T. End flaps are hingedly connected to the end edges of each wall of the tubular structure T so as to be adjacent to the open ends O. Top end flaps 130*a*, 130*b* are hingedly connected to the top wall 120 along fold lines 140*a*, 140*b*, first side end flaps 132*a*, 132*b* are hingedly connected to the first side wall 122 along fold lines 142*a*, 142*b*, second side end flaps 134*a*, 134*b* are hingedly connected to the second side wall 124 along fold lines 144*a*, 144*b*, and bottom end flaps 136*a*, 136*b* are hingedly connected to the bottom wall 126 along fold lines 146*a*, 146*b*. The end flaps 130*a*, 132*a*, 134*a*, 136*a* at each open end 0 of the carton C can be folded and secured to one another to form an end closure structure that defines an end wall of the carton C.

The cartons C are positioned along the length of the carton conveyor 110 and supported on the carton conveyor 110 by spacing lugs 150. The position of each spacing lug 150, or the pitch between certain spacing lugs 150 along the length of the carton conveyor 110, can be adjusted to accommodate various sizes and shapes of cartons C that are configured to receive various sizes and arrangements of articles and/or to select the spacing between cartons C. Means for attaching spacing lugs to conveyors and for adjusting the pitch between spacing lugs is known in the art and is not described in detail herein. The illustrated spacing lugs 150 simply represent the function thereof and can be substituted with other spacing lugs known in the art.

The orientation of the cartons C on the carton conveyor 110 is now described. In the illustrated embodiment, the cartons C are disposed on the carton conveyor 110 such that the bottom wall 126 is in contact with an upper support surface S of the carton conveyor 110. The tubular structure T of each carton C is disposed between spacing lugs 150 so as to be supported in an erected or expanded configuration. The illustrated spacing lugs 150 are attached to the upper support surface S and are substantially perpendicular to the upper support surface S. The spacing lugs 150 extend outwardly from the upper support surface S and abut the side walls 122, 124 of the carton C. The width of the carton conveyor 110 is substantially equal to the distance between the open ends O of the cartons C such that the open ends O of the cartons C are adjacent to edges E of the upper support surface S of the carton conveyor 110.

Figure 5:
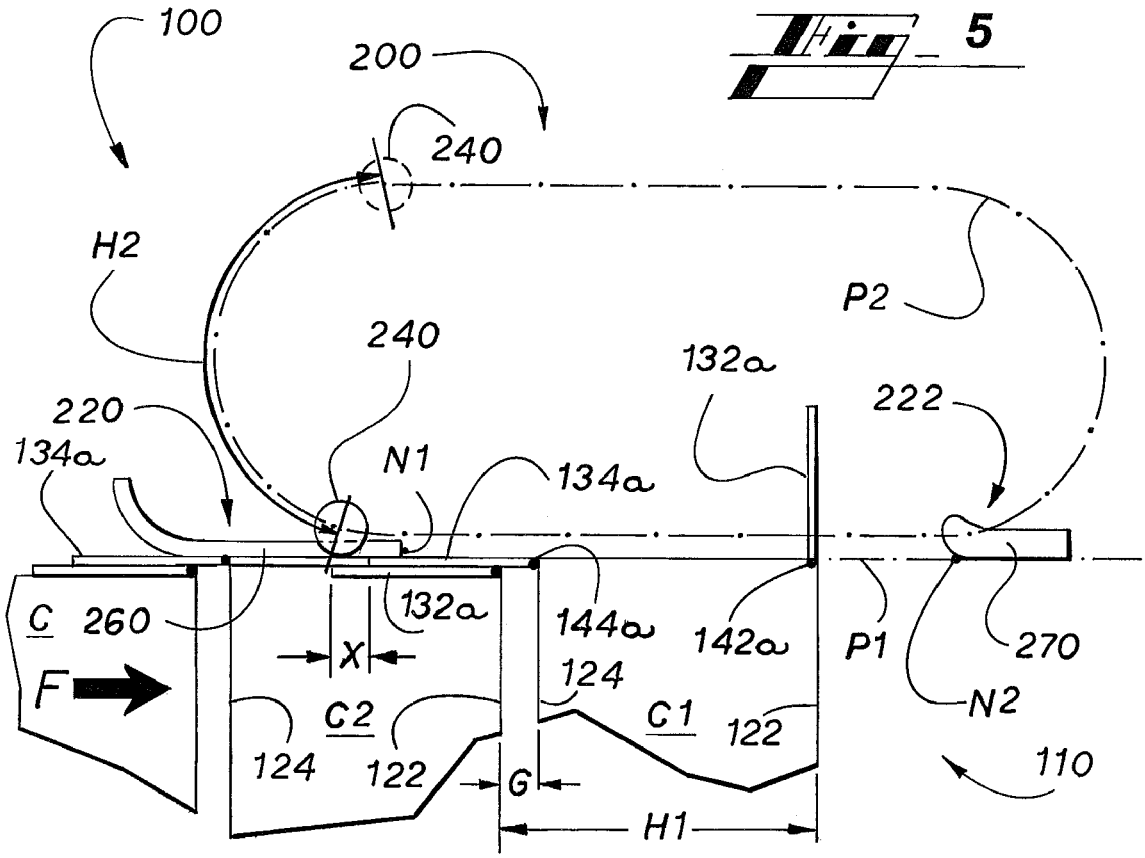
FIGS. 5-9 are partial schematic top views the packaging machine of FIG. 1, which illustrate a first exemplary method for folding the end flaps of a carton.

Referring momentarily to FIG. 5, the pitch H1 between cartons C is a function of the width of the carton C, as measured between the side walls 122, 124 of a carton C, and the width of the gap G between adjacent cartons C, as measured between the side walls 122, 124 of adjacent cartons C. Alternatively described, the pitch H1 between cartons C can be measured between similar elements on the adjacent cartons C, such as the first side walls 122 of adjacent cartons C.

As used herein, the terms "upstream", "downstream", "trailing", and "leading" are related to the flow direction F and are used to describe the position or direction of movement of an element relative to another element. Specifically, the terms "upstream" and "downstream" can describe elements having fixed positions, for example, where a "downstream" element is positioned at a distance in the flow direction F from an "upstream" element. Further, "leading" and "trailing" can describe elements that are moving in the flow direction F, for example, where the "leading" element is further along in the flow direction F than the "trailing" element.

Referring to FIGS. 1, 2, 3A, 3B, and 4, the exemplary folding apparatus 200 includes a support frame 210 that provides the structure which positions certain functional elements of the folding apparatus 200. As used herein, the term "support frame" generally includes any of one or more static support members that may or may not be interconnected.

The functional elements of the folding apparatus 200 include a lug assembly 212, a top guide 216, a bottom guide 218, a separation guide 220, and a combination guide 222.

Figure 3A:
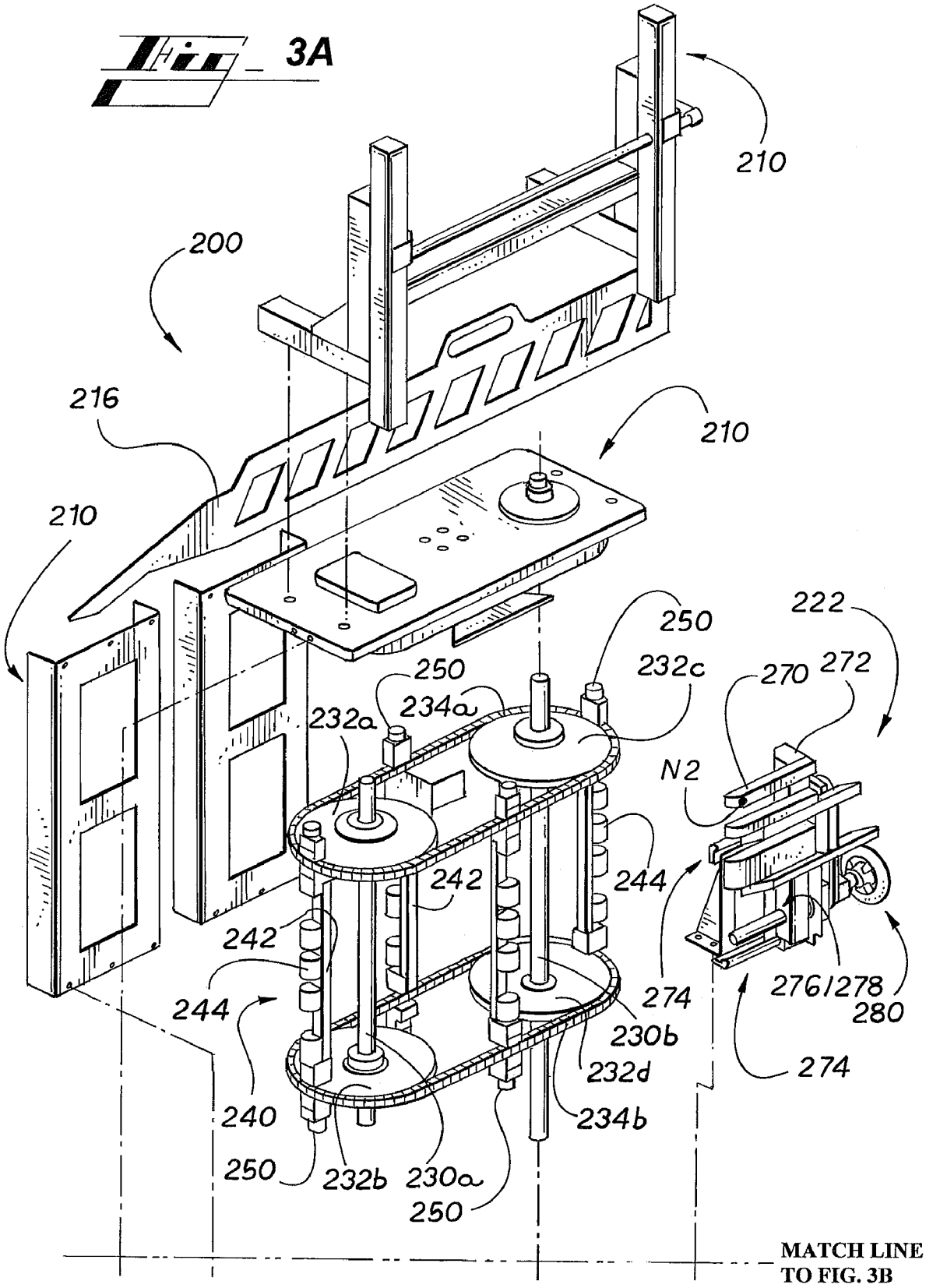
FIGS. 3A and 3B, in combination, are an exploded view of the folding apparatus of FIG. 2.
Figure 4:
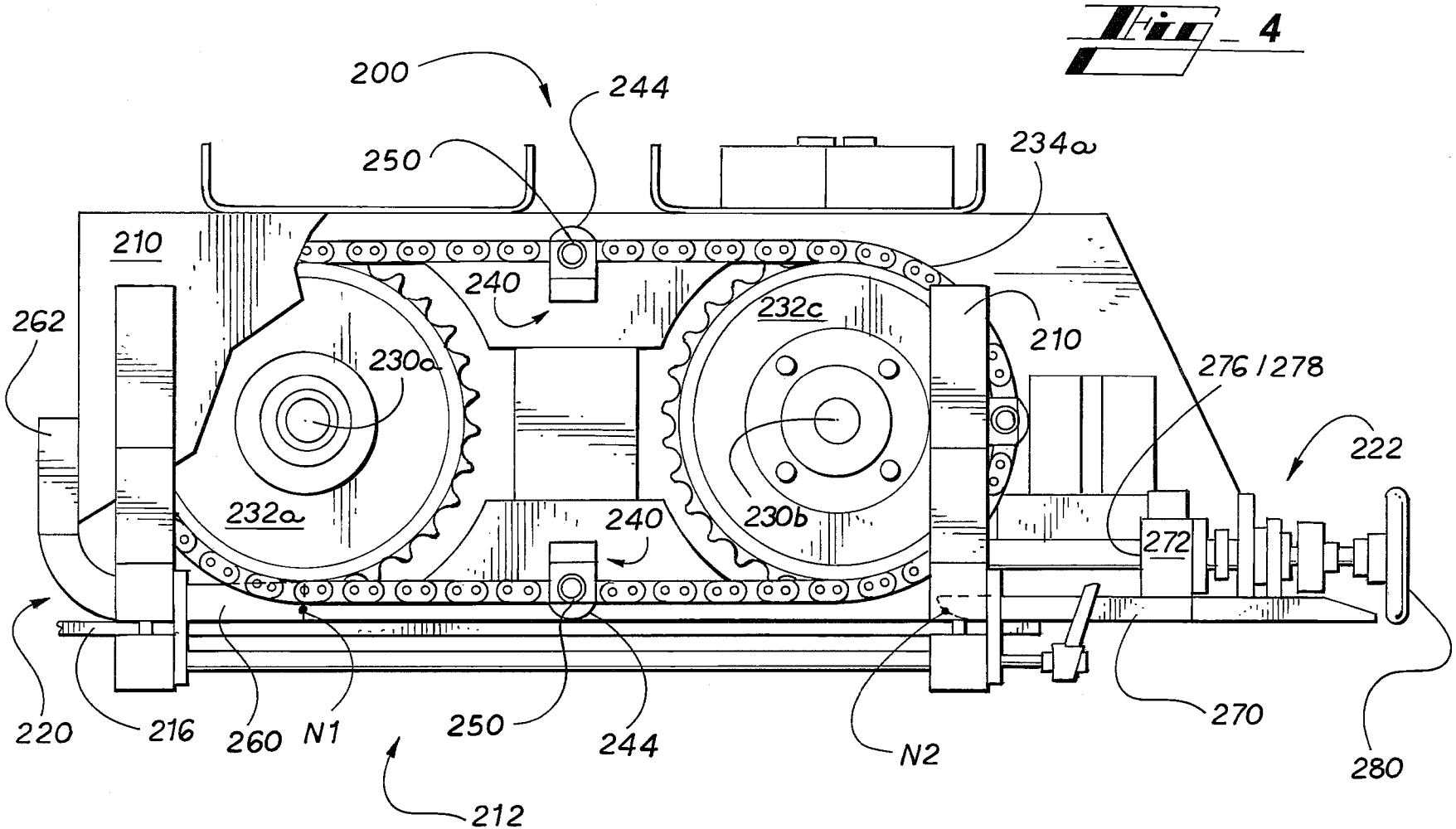
FIG. 4 is a top view of the folding apparatus of FIG. 2.

Referring to FIGS. 3A and 4, the exemplary lug assembly 212 includes first and second axles 230*a*, 230*b* that are substantially vertically oriented. First upper and lower sprockets 232*a*, 232*b* are attached to the first axle 230*a* and second upper and lower sprockets 232*c*, 232*d* are attached to the second axle 230*b*. The upper sprockets 232*a*, 232*c* and the lower sprockets 232*b*, 232*d* are spaced apart from one another along the length of the axles 230*a*, 230*b*, respectively. A first chain 234*a* is tensioned around the upper sprockets 232*a*, 232*c* and a second chain 234*b* is tensioned around the lower sprockets 232*b*, 232*d*.

Folding lugs 240 are attached to each of the first and second chains 234*a*, 234*b* and extend substantially vertically between the chains 234*a*, 234*b*. The chains 234*a*, 234*b* define an endless lug path P2 (shown in FIGS. 5-12) along which the folding lugs 240 travel. In this context, the term "endless" is used to mean that the lug path P2 is in essence a circuit, which may include linear portions and curved portions. In alternative embodiments, the lugs 240 reciprocate along a substantially linear lug path P2. The height of each of the folding lugs 240, is selected so as to be able to fold a range of side end flap heights without being changed over. Further described, the folding lugs 240 do not have to be exchanged or adjusted between runs of cartons C, for example, where the height of side end flaps of cartons C in a first run is different from the height of side end flaps of cartons C in a second run. Further, the folding lugs 240 can fold side end flaps of different heights during a single run of cartons C.

The folding lugs 240 each include a vertically extending bar 242 and protrusions 244 that are spaced along the length of the bar 242. The exemplary lug assembly 212 includes rollers 250 that are received in tracks (not shown) or that follow a surface of the frame 210 so as to support and guide both the folding lugs 240 and the chains 234*a*, 234*b*.

Figure 3B:
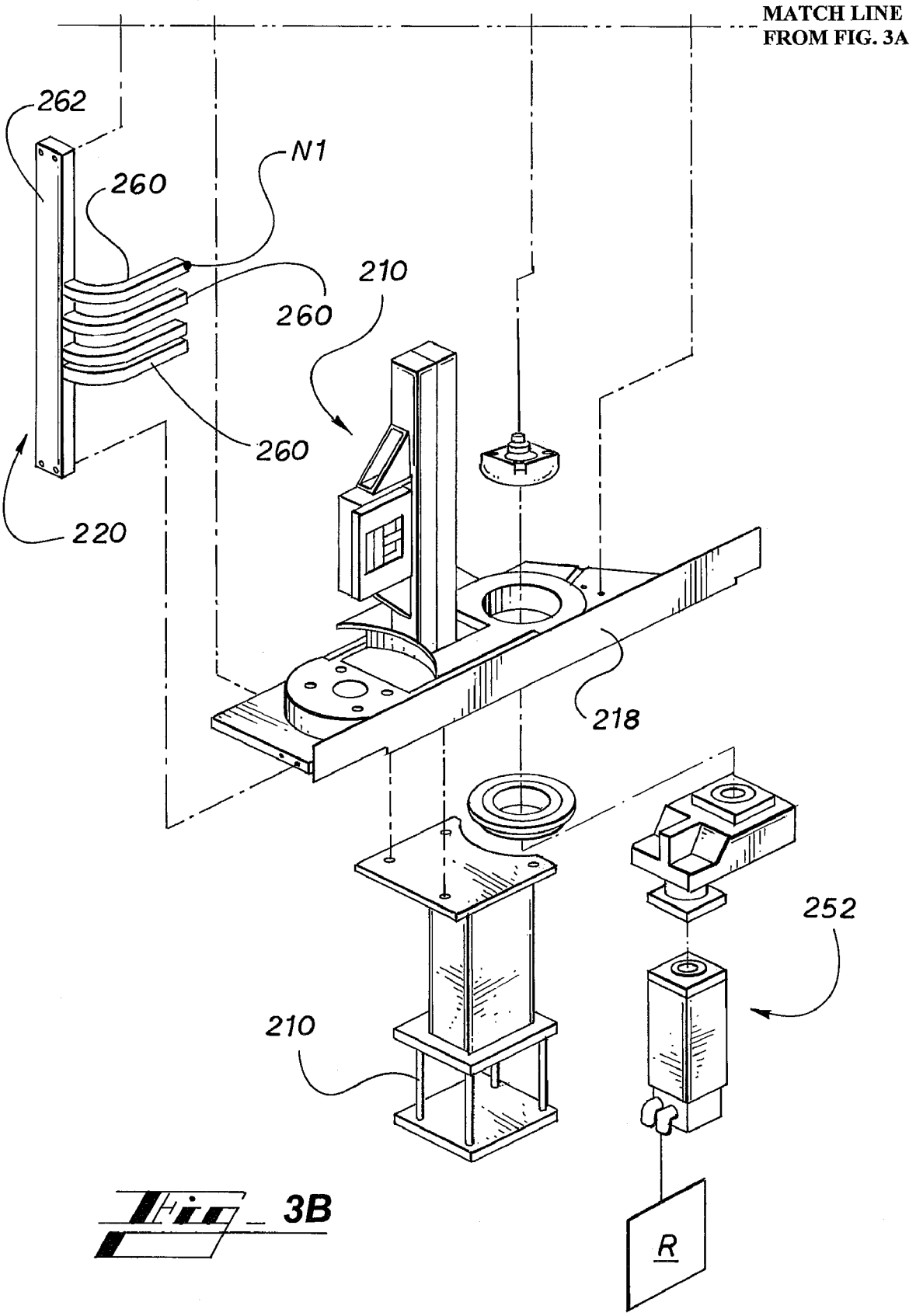

Referring now to FIG. 3B, the axle 230*b* is coupled to means for driving the lug assembly 212, such as a servo motor 252, the operation of which determines the movement, including the position and speed, of the folding lugs 240 along the lug path P2. Means for driving is not limited to servo motors and can include any suitable type of motor or other actuator for generating the motion needed to propel the folding lugs 240 along the lug path P2.

The operation of the servo motor 252 is controlled by means for controlling R, which provides an input thereto. Means for controlling R can include any suitable device or group of devices that serves to govern in some predetermined manner the performance of drive means such as the conveyor motor D or the servo motor 252. Means for controlling R may include controls or an interface that allows a user or application to provide programming or other input including, but not limited to, computers, digital controls, and manual controls. It should be understood that the servo motor 252 can operate at a constant rotational speed or at a variable rotational speed. For example, the servo motor 252 can operate at a speed that is a function of time and that is periodic to move and/or position the folding lugs 240 along the lug path P2 relative to the cartons C traveling along the carton path P1, as described in further detail below. The operation of the servo motor 252 and the operation of the conveyor motor D can be related as each is controlled by means for controlling R.

Referring momentarily to FIG. 5, the pitch H2 between adjacent folding lugs 240 is measured along the lug path P2. It is contemplated that folding lugs 240 can be attached to, detached from, and positioned along the length of the chains 234*a*, 234*b* to change or select the pitch H2. The pitches H1, H2 are related to one another and to the average speeds of the folding lugs 240 and the cartons C over a period of time where a folding lug 240 folds a carton C, as described in further detail below.

Referring again FIGS. 1, 2, 3A, and 4, the top guide 216 is attached to the support frame 210 and is dimensioned and positioned to guide the top end flaps 130*a* of cartons C traveling along the carton path P1. Specifically, the top guide 216 is positioned above the lug assembly 212, and, referring to FIG. 1, functions to fold the top end flaps 130*a* of cartons C outwardly as the lug assembly 212, separation guide 220, and combination guide 222 function to fold the side end flaps 132*a*, 134*a*, as described in further detail below. Similarly, referring the FIGS. 2 and 3B, the bottom guide 218 is attached to the support frame 210 and is positioned and dimensioned to guide the bottom end flaps 136*a*.

Referring to FIGS. 1, 2, 3B, and 4, the separation guide 220 is positioned at the upstream end of the folding apparatus 200 and includes a series of deflecting guide rails 260 that are attached to, and extend substantially horizontally from, a vertically extending support bar 262. The proximal or upstream end of each of the deflecting guide rails 260 is shaped or curved to facilitate folding the side end flaps of the cartons C. The distal or downstream end of each of the deflecting guide rails 260 defines a release point N1, as described in further detail below.

Referring to FIGS. 1, 2, 3A, and 4, the combination guide 222 is positioned at the downstream end of the folding apparatus 200 and includes a series of closing guide rails 270 that are attached to, and extend substantially horizontally from, a translating structure 272. The translating structure 272 can slide relative to the frame 210 to adjust the position of the closing guide rails 270. The upstream end of each of the closing guide rails 270 defines a contact point N2, the position of which can be adjusted by operating the translating structure 272. In the exemplary embodiment, the translating structure 272 can slide along a linear bearing 274. The translating structure 272 includes a threaded aperture 276 that receives a threaded rod 278 and, by turning a handwheel 280 to rotate the threaded rod 278, the translating structure 272 can move in either of opposite directions along the linear bearing 274 and relative to the frame 210.

The folding lugs 240 are configured to cooperate with the separation guide 220 and the combination guide 222. Specifically, the protrusions 244 of each folding lug 240 are vertically offset from the guide rails 260, 270 of the guides 220, 222 such that the protrusions 244 can move through the spaces between the guide rails 260, 270 as the folding lugs 240 travel along the lug path P2. Thereby, the folding lugs 240 can contact the surface of a side end flap 132*a*, 134*a* at a point that is upstream of the release point N1 or downstream of the contact point N2 without being obstructed by the separation guide 220 or the combination guide 222.

The contour and position of surfaces of the folding apparatus 200 that contact the end flaps of the cartons C, such as surfaces of the separation guide 220, the folding lugs 240, and the combination guide 222, determine how and when the side end flaps are folded. For example, the closer the contact surfaces are to a vertical plane that is defined by the fold lines 142*a*, 144*a*, the faster the side end flaps will be folded as the cartons move past the separation guide 220 and combination guide 222. It should be understood that the contact surfaces of the folding lugs 240 and of the guide rails 260, 270 can be offset at different distances from the vertical plane to accomplish the folding methods described herein.

Referring now to FIGS. 5-9, a first exemplary method of forming end closure structures of cartons C with the packaging machine 100 is described. It should be understood that the exemplary methods described herein are for purposes of teaching and are not limiting. In general, the packaging machine 100 forms the end closure structures of a substantially continuously or intermittently moving sequence of cartons C, one after another, by repeatedly performing certain steps. For simplicity, steps of the first exemplary method are described for a single carton C.

In FIGS. 5-12, for clarity, one of the cartons C is designated a leading carton C1 and an adjacent carton C is designated a trailing carton C2 to distinguish the cartons C1, C2 from one another. Also, the side end flaps 132*a*, 134*a* of each carton C1, C2 are designated as leading and trailing side end flaps, respectively, to distinguish the side end flaps from one another.

Beginning with FIG. 5, the cartons are transported in the flow direction F along the carton path P1 by the carton conveyor 110 and the folding lugs 240 are driven along the lug path P2. Along a portion of the lug path P2, the folding lugs 240 travel substantially in the flow direction F and are in working reach of cartons C on the carton conveyor 110.

The pitch H1 between cartons C, the pitch H2 between folding lugs 240, the average speed of cartons C in the flow direction F over a selected period of time, and the average speed of folding lugs 240 in the flow direction F over the selected period of time are related to one another. Specifically, the frequency of cartons C passing a fixed point on the carton path P1 is substantially equal to the frequency of folding lugs 240 passing a fixed point on the lug path P2. The frequency of cartons C passing a fixed point on the carton path P1 is substantially equal to the average speed of the cartons C over the selected period of time divided by the pitch H1 between the cartons C and the frequency of folding lugs 240 passing a fixed point on the lug path P2 is substantially equal to the average speed of the folding lugs 240 over the selected period of time divided by the pitch H2 between folding lugs 240. The selected period of time can be defined as the time it takes to complete one cycle of operations for one carton C.

Referring to FIG. 1, upstream of the folding apparatus 200, the end flaps of the cartons C are substantially coplanar with a wall to which they are attached (as shown for end flaps 130*b*, 132*b*, 134*b*, 136*b*). As the cartons C reach the upstream end of the folding apparatus 200, the top guide 216 folds the top end flap 130*a* outwardly and the bottom guide 218 folds the bottom end flap 136*a* outwardly. Thereby, the top end flap 130*a* and the bottom end flap 136*a* are positioned so as not to obstruct the folding apparatus 200 as the side end flaps 132*a*, 134*a* are folded.

As the cartons reach the separation guide 220, the side end flaps 132*a*, 134*a* are folded by the deflecting guide rails 260 along the fold lines 142*a*, 144*a*. In FIG. 1, the side end flaps 132*a*, 134*b* are illustrated as being folded by the separation guide 220 although the carton C has not yet reached the separation guide 220. In FIG. 5, the side end flaps 132*a*, 134*a* of the trailing carton C2 are folded by the separation guide 220.

The side end flaps 132*a*, 134*a* are folded by the separation guide 220 such that the distal ends of the side end flaps 132*a*, 134*a* extend in a substantially upstream direction. As shown in FIG. 5, the side end flaps 132*a*, 134*a* of the trailing carton C2 are folded so as to be substantially perpendicular to the side walls 122, 124 to which they are attached. In alternative embodiments, the separation guide 220 can be positioned to be further offset or distanced from the end of the carton C such that the separation guide 220 folds the side end flaps 132*a*, 134*a* so as to be at an acute angle with respect to a plane defined by the side walls 122, 124 to which they are attached. In such embodiments, the distal ends of the side end flaps 132*a*, 134*a* slide across the contact surface of the separation guide 220.

Continuing with FIG. 5, in the first exemplary embodiment, the length of the trailing side end flap 134*a* of the leading carton C1 is greater than the width of the gap G between the cartons C1, C2 such that the trailing side end flap 134*a* of the leading carton C1 at least partially overlaps the leading side end flap 132*a* of the trailing carton C2 when folded by the separation guide 220. The length of the leading side end flap 132*a* of the trailing carton C2 is such that the distal end thereof extends further upstream than the distal end of the trailing side end flap 134*a* of the leading carton C1 and the distal ends are separated from one another by a distance X. Accordingly, the distal end of the trailing side end flap 134*a* of the leading carton C1 reaches the release point N1 at the downstream end of the separation guide 220 before the distal end of the leading side end flap 132*a* of the trailing carton C2. Each end flap 132*a*, 134*a* is released as its distal end reaches the release point N1.

Figure 6:
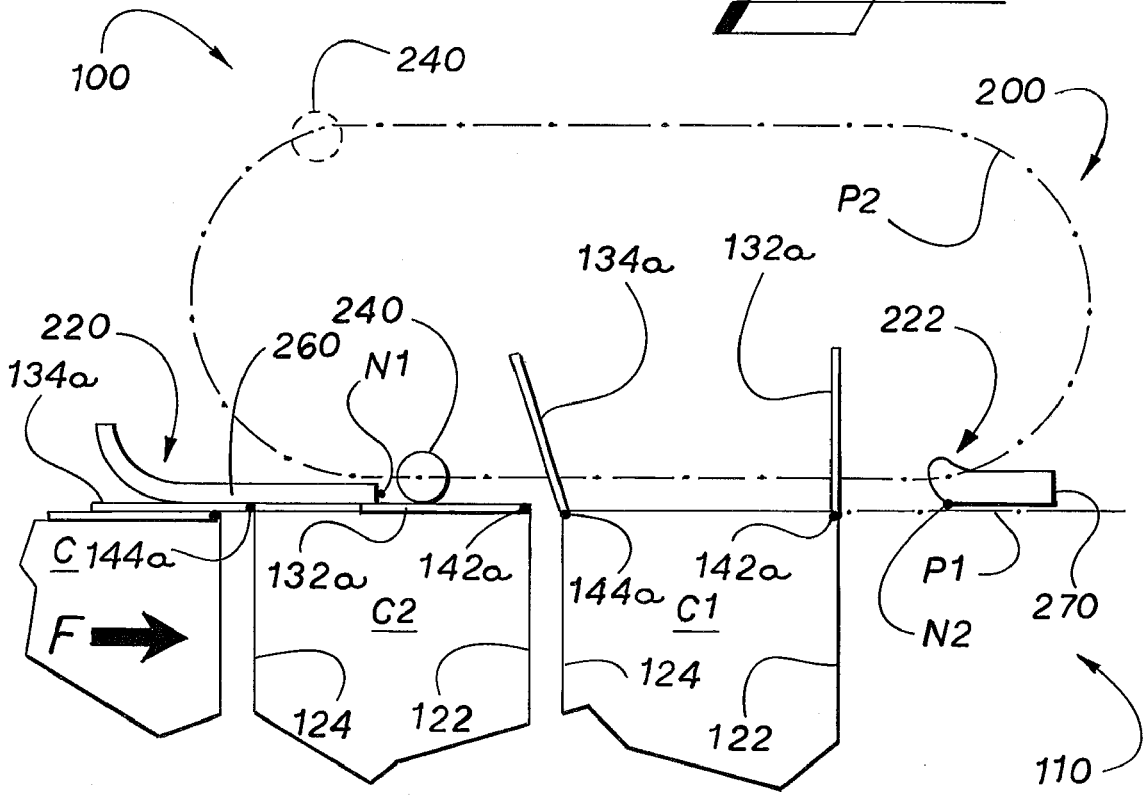
Figure 7:
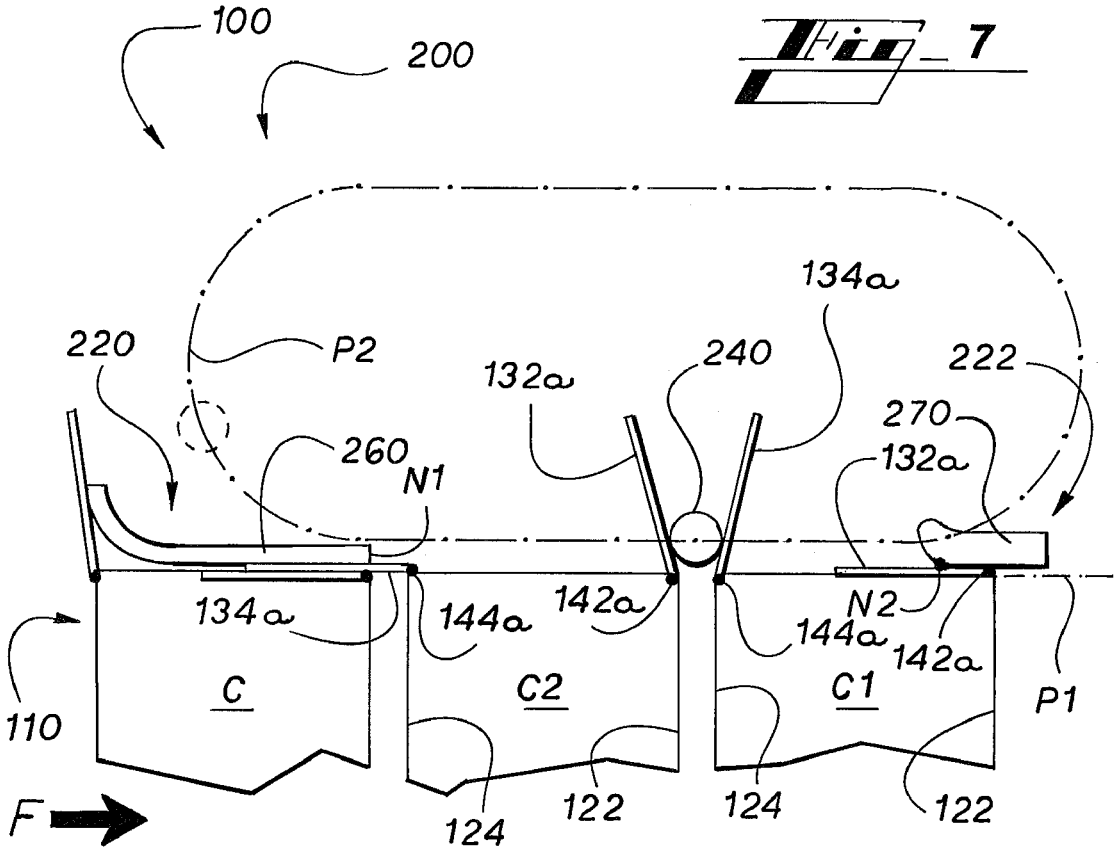
Figure 8:
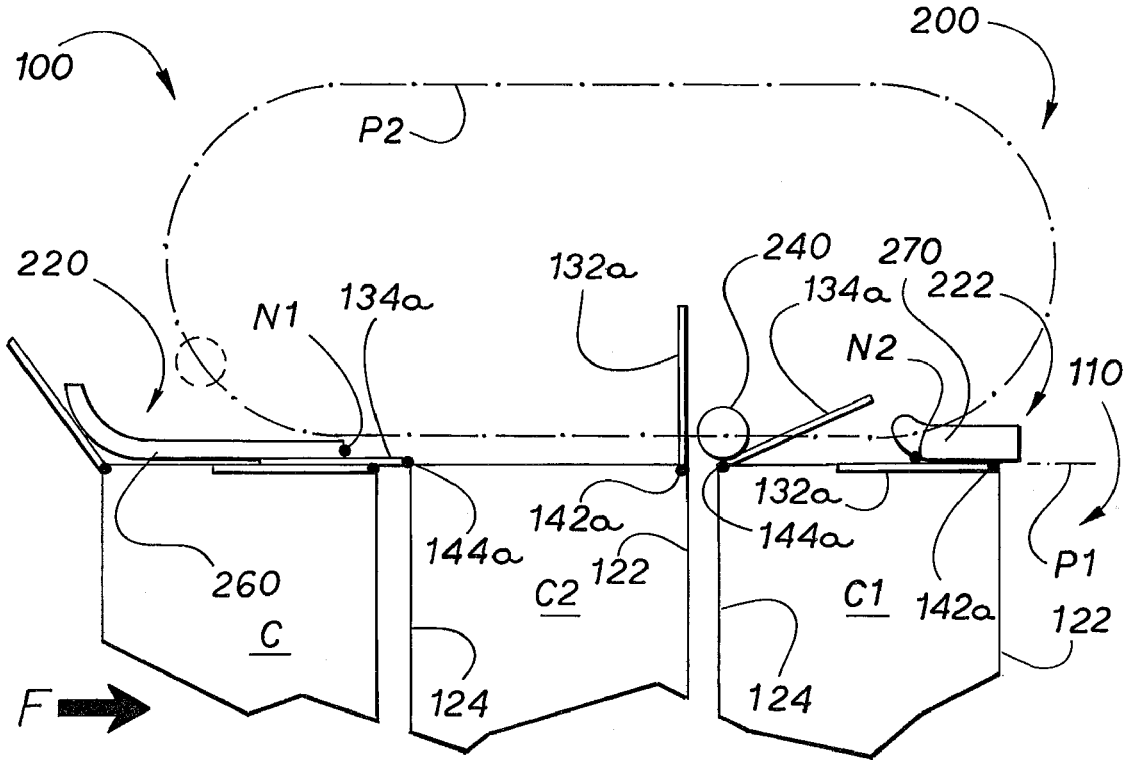

Referring now to FIGS. 5-7, once the trailing side end flap 134*a* of the leading carton C1 is released, the folding lug 240 is moved past the release point N1 so as to be positioned to fold the trailing side end flap 134*a*. Specifically, the folding lug 240 remains upstream of the release point N1 until the trailing side end flap 134*a* of the leading carton C1 is released and moves downstream of the release point N1 before the leading side end flap 132*a* of the trailing carton C2 is released. The folding lug 240 has a limited amount of time to pass the release point N1 after the distal end of the trailing side end flap 134*a* of the leading carton C1 passes the release point N1. The amount of time is substantially equal to the distance X divided by the speed of the cartons C. As shown in FIG. 8, once the leading side end flap 132*a* of the trailing carton C2 is released, the folding lug 240 is positioned between the trailing side end flap 134*a* of the leading carton C1 and the leading side end flap 132*a* of the trailing carton C2.

Once the side end flaps 132*a*, 134*a* are released by the separation guide 220, the resiliency of the material from which the carton 200 is formed causes the side end flaps 132*a*, 134*a* to return towards a position that is substantially coplanar with the side wall 122, 124 to which they are attached.

Figure 9:
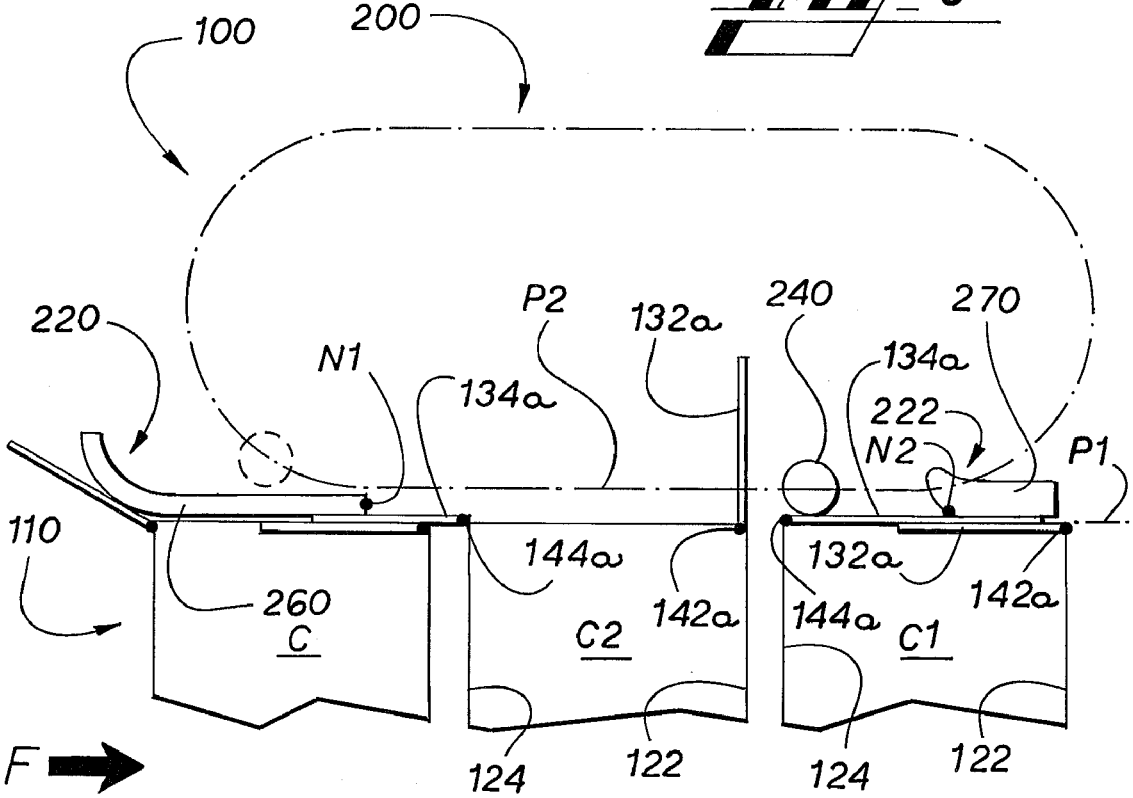

Turning to FIGS. 7-9, according to the first exemplary method, the trailing side end flap 134*a* of the leading carton C1 is to be folded to overlap the leading side end flap 132*a* of the leading carton C1. Thus, the folding lug 240 does not fold the trailing side end flap 134*a* until the combination guide 222 folds the leading side end flap 132*a*. The leading side end flap 132*a* of the leading carton C1 is folded in the upstream direction as the leading side end flap 132*a* reaches the contact point N2 of the combination guide 222. Once the leading side end flap 132*a* is at least partially folded, the folding lug 240 has a limited amount of time to fold the trailing side end flap 134*a* to overlap the leading side end flap 132*a* so as to prevent the trailing side end flap 134*a* from being obstructed by the combination guide 222. In order to fold the trailing side end flap 134*a* of the leading carton C1, the folding lug 240 increases speed in the flow direction F in a controlled manner. Once the trailing side end flap 134*a* is folded to overlap the leading side end flap 132*a*, the combination guide 222 holds the side end flaps 132*a*, 134*a* in the folded overlapping arrangement.

The position and speed of the folding lug 240 relative to the position and speed of the leading carton C1 determines when, where, and how the trailing side end flap 134*a* of the leading carton C1 is folded. For example, the position and speed of the folding lug 240 can be selected to fold the trailing side end flap 134*a* at a certain rate and/or to hold the trailing side end flap 134*a* at a certain folded position.

Figure 10:
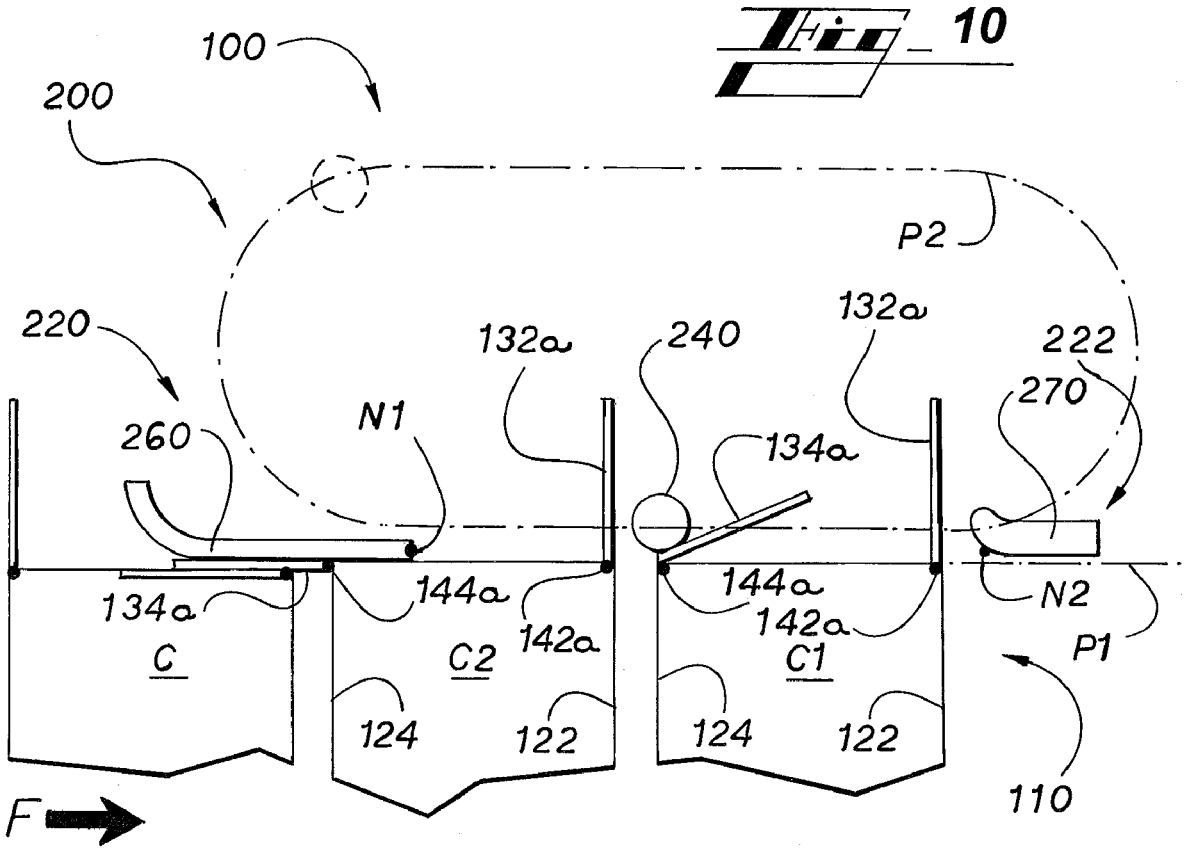
FIGS. 10-12 are partial schematic top views of the packaging machine of FIG. 1, which illustrate a second exemplary method for folding the end flaps of a carton.
Figure 11:
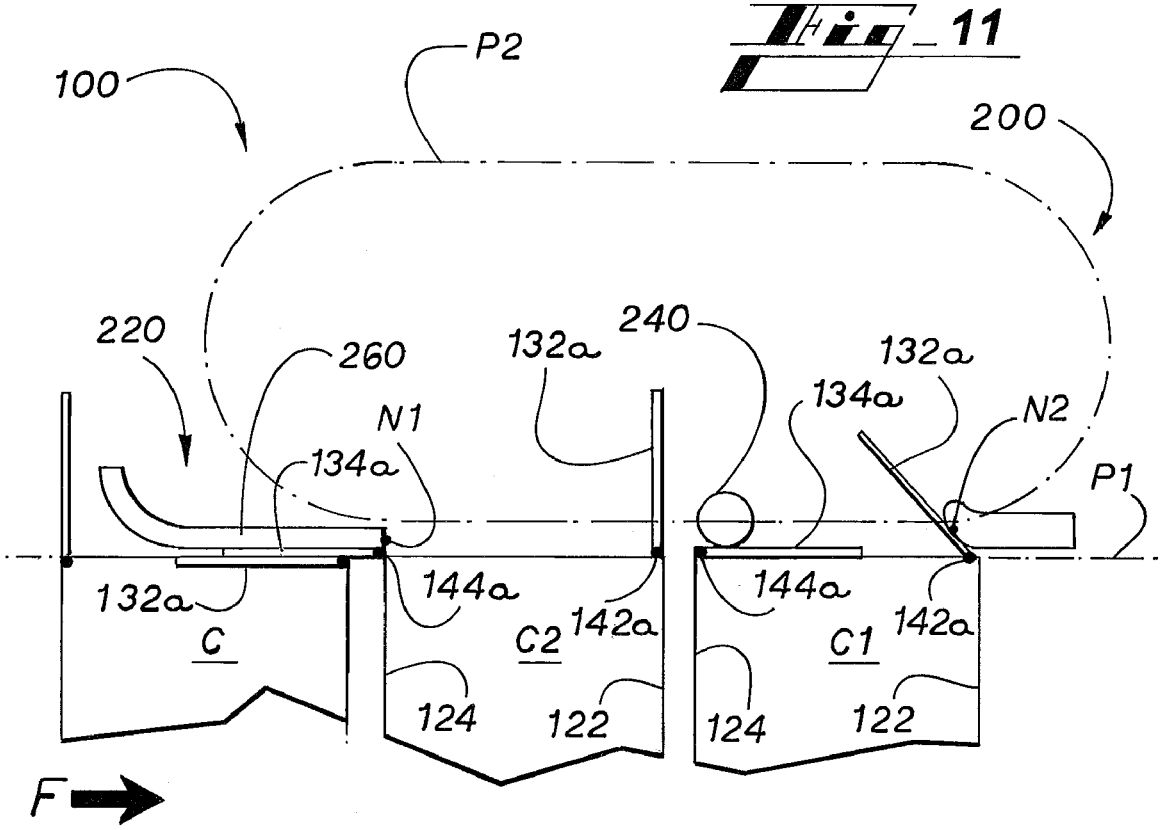
Figure 12:
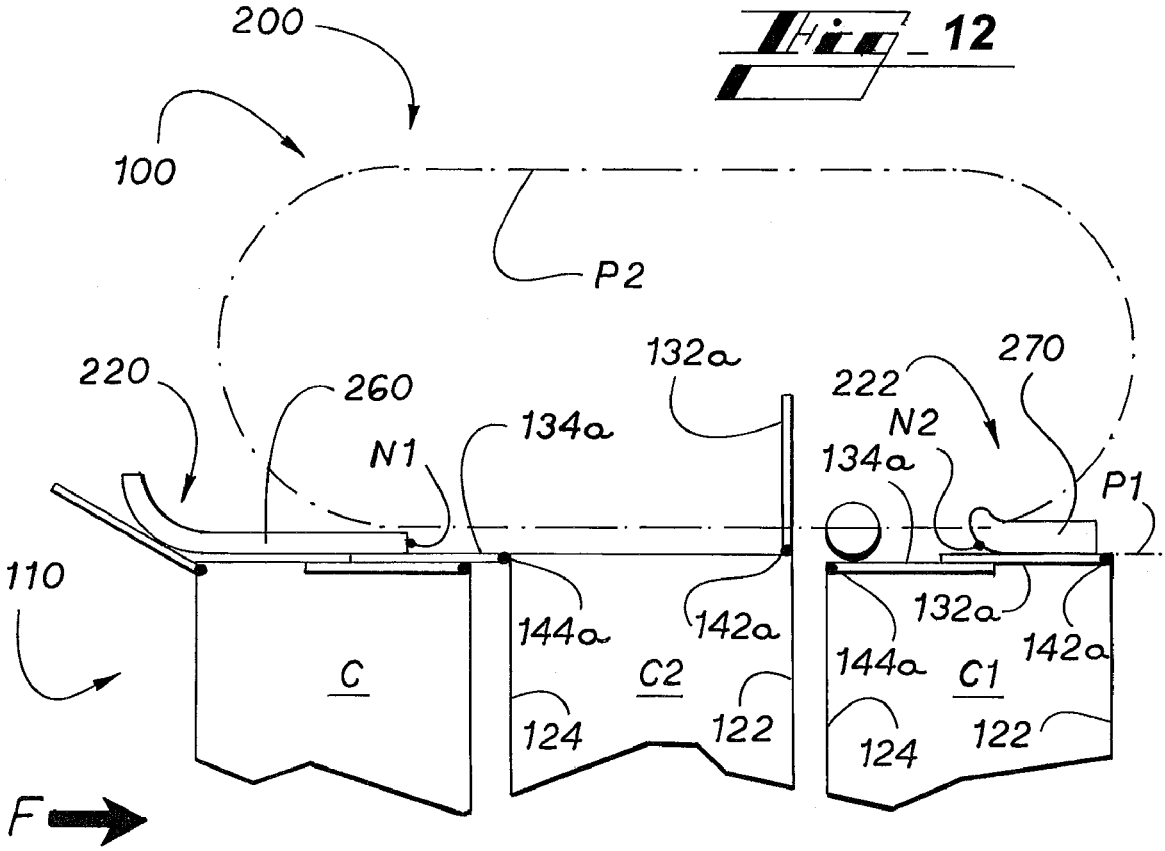

Turning now to FIGS. 10-12, according to a second exemplary method, the leading side end flap 132*a* of the leading carton C1 is to be folded to overlap the trailing side end flap 134*a* of the leading carton C1. Thus, once the trailing side end flap 134*a* is released by the separation guide 220, the folding lug 240 folds the trailing side end flap 134*a* before the combination guide 222 folds the leading side end flap 132*a*. The folding lug 240 folds the trailing side end flap 134*a* and then holds position near the proximal end of the trailing side end flap 134*a* so as not to obstruct the leading side end flap 132*a* as it is folded by the combination guide 222.

The position of the contact point N2, or otherwise the combination guide 222, can be adjusted to select when and where along the path P1 the leading side end flap 132*a* is folded. Thereby, the time at which the leading side end flap 132*a* is folded by the combination guide 222 can be phased relative to the time at which the trailing side end flap 134*a* is folded by the folding lug 240 to select which of the side end flaps 132*a*, 134*a* overlaps the other. For example, the contact point N2 can be moved upstream to fold the leading side end flap 132*a* earlier with respect to the folding time of the trailing side end flap 134*a*, for example, such that the trailing side end flap 134*a* overlaps the leading side end flap 132*a*. Conversely, the contact point N2 can be moved downstream to fold the leading side end flap 132*a* later with respect to the folding time of the trailing side end flap 134*a*, for example, such that the leading side end flap 132*a* overlaps the trailing side end flap 134*a*. It should be noted that the speed and position of the folding lug 240 can be controlled to select the time at which the trailing side end flap 132*a* is folded. Thus, the time at which each of the side end flaps 132*a*, 134*a* are folded can be selected to optimize the folding procedure.

In alternative embodiments where the side end flaps 132*a*, 134*a* of the carton C do not overlap one another when folded, the side end flaps 132*a*, 132*b* can be folded according to either of the exemplary methods described above or variations thereof.

In alternative embodiments, adjustments to the folding procedure can be made to accommodate cartons C that have end flaps 132*a*, 134*a* that are different lengths, cartons C that have different widths, and where the gap between cartons C1, C2 is different.

The above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

What is claimed is:

1. A packaging machine for closing an end of an end loaded carton, the carton having leading and trailing side end flaps, the packaging machine comprising:

a carton conveyor for transporting said carton in a flow direction along a first path; and a folding apparatus, comprising:

a lug assembly, comprising at least one folding lug that travels along a second path, said at least one folding lug comprising an extending bar and protrusions said protrusions being spaced along the length of said bar, and said at least one folding lug traveling in said flow direction along at least a portion of said second path that is substantially parallel to said first path;

a separation guide, comprising deflecting guide rails having spaces between and attached to a support bar, disposed at an upstream end of said folding apparatus; and a combination guide, comprising closing guide rails having spaces between and attached to a translating structure, disposed at a downstream end of said folding apparatus;

wherein said protrusions of said at least one folding lug are vertically offset from said deflecting guide rails and said closing guide rails such that said protrusions can move through said spaces between said deflecting guide rails and said spaces between said closing guide rails as said at least one folding lug travels along said second path.

2. The packaging machine of claim 1, wherein said first path is substantially linear.

3. The packaging machine of claim 1, wherein said second path is endless.

4. The packaging machine of claim 1, wherein the speed and position of said at least one folding lug along the first path are synchronized with the speed and position of said carton along the second path.

5. The packaging machine of claim 1, further comprising means for driving said carton conveyor, means for driving said lug assembly, and means for controlling said means for driving said carton conveyor and said means for driving said folding apparatus.

* * * * *